US010127881B2

(12) United States Patent
Wang et al.

(10) Patent No.: US 10,127,881 B2
(45) Date of Patent: Nov. 13, 2018

(54) DISPLAY DRIVING CIRCUIT, DISPLAY DEVICE AND DRIVING METHOD THEREOF

(71) Applicants: BEIJING BOE DISPLAY TECHNOLOGY CO., LTD., Beijing (CN); BOE TECHNOLOGY GROUP CO., LTD., Beijing (CN)

(72) Inventors: Jianming Wang, Beijing (CN); Liang Zhang, Beijing (CN); Yizhen Xu, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/236,298

(22) PCT Filed: May 20, 2013

(86) PCT No.: PCT/CN2013/075893

§ 371 (c)(1),
(2) Date: Jan. 30, 2014

(87) PCT Pub. No.: WO2014/146343

PCT Pub. Date: Sep. 25, 2014

(65) Prior Publication Data

US 2014/0333594 A1 Nov. 13, 2014

(30) Foreign Application Priority Data

Mar. 18, 2013 (CN) ..... 2013 1 0086096

(51) Int. Cl.
*G09G 3/36* (2006.01)

(52) U.S. Cl.
CPC ..... *G09G 3/3696* (2013.01); *G09G 3/3648* (2013.01); *G09G 3/3655* (2013.01);
(Continued)

(58) Field of Classification Search
CPC .. G09G 3/3696; G09G 3/3648; G09G 3/3655; G09G 2310/06; G09G 2320/0219; G09G 2320/0247; G09G 2330/027
(Continued)

(56) References Cited

U.S. PATENT DOCUMENTS

2001/0012084 A1* 8/2001 Ohta ..... G02F 1/134363 349/141
2008/0158136 A1* 7/2008 Kaneda ..... G09G 3/3413 345/102
(Continued)

FOREIGN PATENT DOCUMENTS

CN 1987620 A 6/2007
CN 101354870 A 1/2009
(Continued)

OTHER PUBLICATIONS

International Search Report for International Application No. PCT/CN2013/075893, 12pgs.
(Continued)

*Primary Examiner* — Jonathan Blancha
(74) *Attorney, Agent, or Firm* — Ladas & Parry LLP

(57) ABSTRACT

Provided are a display driving circuit, a display device and a driving method thereof, which are capable of avoiding an influence of a feed through effect on a voltage difference between a pixel electrode and a common electrode and thus improving the quality of a displayed picture. The display driving circuit comprises a gate driving unit for controlling a thin film transistor TFT to be turned on, a source driving unit for outputting a signal to a source of the TFT, and a circuit unit for supplying a power to a common electrode, the circuit unit outputs a first voltage to the common electrode when the TFT is in a turn-on state, and the circuit unit outputs a second voltage to the common electrode when
(Continued)

the TFT is in a turn-off state, wherein the first voltage is a voltage different from the second voltage.

14 Claims, 3 Drawing Sheets

(52) U.S. Cl.
CPC . *G09G 2310/06* (2013.01); *G09G 2320/0219* (2013.01); *G09G 2320/0247* (2013.01); *G09G 2330/027* (2013.01)

(58) Field of Classification Search
USPC ..... 345/98, 208
See application file for complete search history.

(56) References Cited

U.S. PATENT DOCUMENTS

| | | | | |
|---|---|---|---|---|
| 2008/0174583 | A1* | 7/2008 | Lee | G09G 3/3688 345/211 |
| 2009/0295698 | A1* | 12/2009 | Kamio | G09G 3/3648 345/92 |
| 2010/0315322 | A1* | 12/2010 | Cheng et al. | 345/99 |
| 2011/0169790 | A1* | 7/2011 | Yanagawa et al. | 345/204 |
| 2013/0257838 | A1* | 10/2013 | Lin | G09G 3/3648 345/212 |

FOREIGN PATENT DOCUMENTS

| | | | | |
|---|---|---|---|---|
| CN | 101354870 | A | * | 6/2010 |
| CN | 1987620 | B | * | 12/2010 |
| CN | 102610205 | A | * | 7/2012 |
| CN | 102610205 | A | | 7/2012 |
| JP | 2002-202493 | A | | 7/2008 |

OTHER PUBLICATIONS

English abstract of CN1987620A, listed above, 1 page.
English abstract of CN102610205A, listed above, 2 pages.
First Office Action (Chinese language) issued by the State Intellectual Property Office ("SIPO") dated Sep. 17, 2014 for international application No. 201310086096.3, 6 pages.
English translation of first Office Action (listed above) issued by SIPO for international application No. 201310086096.3, 6 pages.
Second Office Action (Chinese language) issued by the State Intellectual Property Office dated Feb. 13, 2015 for International Application No. 201310086096.3, four (4) pages.
English translation of second Office Action (listed above) issued by SIPO dated Feb. 13, 2015 for International Application No. 201310086096.3, four (4) pages.
International Preliminary Report on Patentability Appln. No. PCT/CN2013/075893; dated Sep. 22, 2015.
Third Chinese Office Action Appln. No. 201310086096.3; dated Jul. 14, 2015.

* cited by examiner

DISPLAY DRIVING CIRCUIT, DISPLAY DEVICE AND DRIVING METHOD THEREOF

CROSS REFERENCE TO RELATED APPLICATIONS

This application is based on International Application No. PCT/CN2013/075893 filed on May 20, 2013, which claims priority to Chinese National Application No. 201310086096.3 filed on Mar. 18, 2013, the contents of which are incorporated herein by reference.

TECHNICAL FIELD OF THE DISCLOSURE

The present disclosure relates to a field of display technology, and particularly to a display driving circuit, a display device and a driving method thereof.

BACKGROUND

With a continual development of the Thin Film Transistor-Liquid Crystal Display (TFT-LCD) technology, how to improve a quality of picture in a display device becomes a focus concerned by people increasingly.

As for an existing TFT liquid crystal display device, at the moment that TFT is turned off, a potential at a drain of the TFT is reduced suddenly relative to a potential at a source of the TFT, and a potential difference between a pixel electrode and a common electrode has a sudden voltage transition inevitably, waveforms of respective voltage signals may be as shown in FIG. 1. At the moment that a gate voltage Vg of the TFT outputs a low level, a drain voltage of the TFT is decreased suddenly relative to a source voltage of the TFT, the voltage difference ΔVf decreased is referred to as a Feed Through voltage and such a phenomenon is referred to as a Feed Through effect. The drain voltage Vd of the TFT is decreased due to the feed through effect and the potential of the pixel electrode connected to the drain of the TFT is also decreased, such that the voltage difference between the voltage at the pixel electrode and the voltage at a common electrode is less than a predetermined voltage difference, which may have an influence on deflections of liquid crystal molecules and in turn on a light transmittance rate and a luminance of the liquid crystal display device, thus a flicker phenomenon may appear in the liquid crystal display device and the quality of the displayed picture may be seriously affected.

SUMMARY

In embodiments of the present disclosure, there are provided a display driving circuit, a display device and a driving method thereof, which may be capable of avoiding the influence of the feed through effect on the voltage difference between the pixel electrode and the common electrode and thus improving the quality of the displayed picture.

In order to achieve the above purpose, the embodiments of the present disclosure adopt the following technical solutions.

According to one aspect of the present disclosure, there is provided a display driving circuit comprising a gate driving unit for controlling a thin film transistor TFT to be turned on, a source driving unit for outputting a signal to a source of the TFT, and a circuit unit for supplying a power to a common electrode.

When the TFT is in a turn-on state, the circuit unit outputs a first voltage to the common electrode; when the TFT is in a turn-off state, the circuit unit outputs a second voltage to the common electrode, wherein the first voltage is a voltage different from the second voltage.

According to another aspect of the present disclosure, there is provided a display device comprising a display substrate, a display region of the display substrate comprises pixel units, each of the pixel units comprises thin film transistors TFTs, and the display device further comprises the above described display driving circuit.

According to another aspect of the present disclosure, there is provided a display driving method applied to a display driving circuit comprising a gate driving unit for controlling a thin film transistor TFT to be turned on, a source driving unit for outputting a signal to a source of the TFT, and a circuit unit for supplying a power to a common electrode, the display driving method comprises: the circuit unit outputs a first voltage to the common electrode when the TFT is in a turn-on state; and the circuit unit outputs a second voltage to the common electrode when the TFT is in a turn-off state, wherein the first voltage is a voltage different from the second voltage.

In the display driving circuit, the display device and the driving method thereof provided in the embodiments of the present disclosure, when the TFT is in a turn-on state, the circuit unit outputs the first voltage to the common electrode; when the TFT is in a turn-off state, the circuit unit outputs the second voltage to the common electrode, wherein the first voltage is the voltage different from the second voltage. Adopting two different voltages as reference voltages of the common electrode, the voltage of the common electrode transfers from the first voltage to the second voltage while there is a voltage transition in the voltage of the pixel electrode due to the feed through effect, such that the voltage difference between the pixel electrode and the common electrode may be maintained effectively at a required pixel voltage by controlling a relationship between values of the first voltage and the second voltage, and thus the influence of the feed through effect on the voltage difference between the pixel electrode and the common electrode may be effectively eliminated and the quality of displayed picture may be significantly improved.

DETAILED DESCRIPTION

Below, the technical solutions in the embodiments of the present disclosure will be described clearly and thoroughly with reference to the accompanying drawings of the embodiments of the present disclosure. Obviously, the embodiments as described are only some of the embodiments of the present disclosure, and are not all of the embodiments of the present disclosure. All other embodiments obtained by those skilled in the art based on the embodiments in the present disclosure without paying any inventive labor should fall into the protection scope of the present disclosure.

Figure 1:
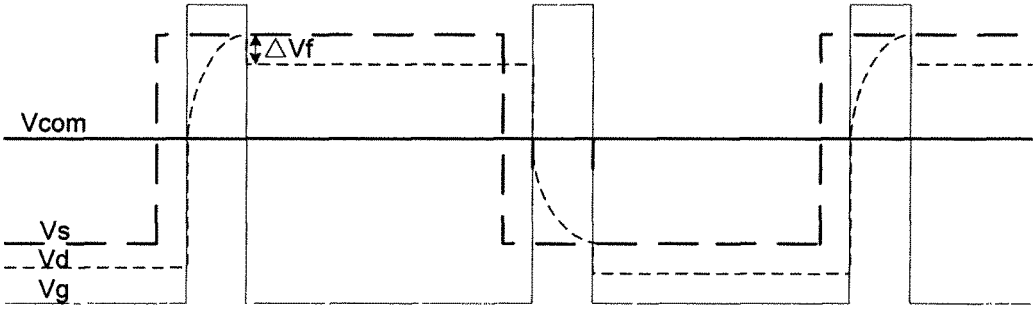
FIG. 1 is a waveform diagram of signals during a process that an existing driving circuit performs a display driving.
Figure 2:
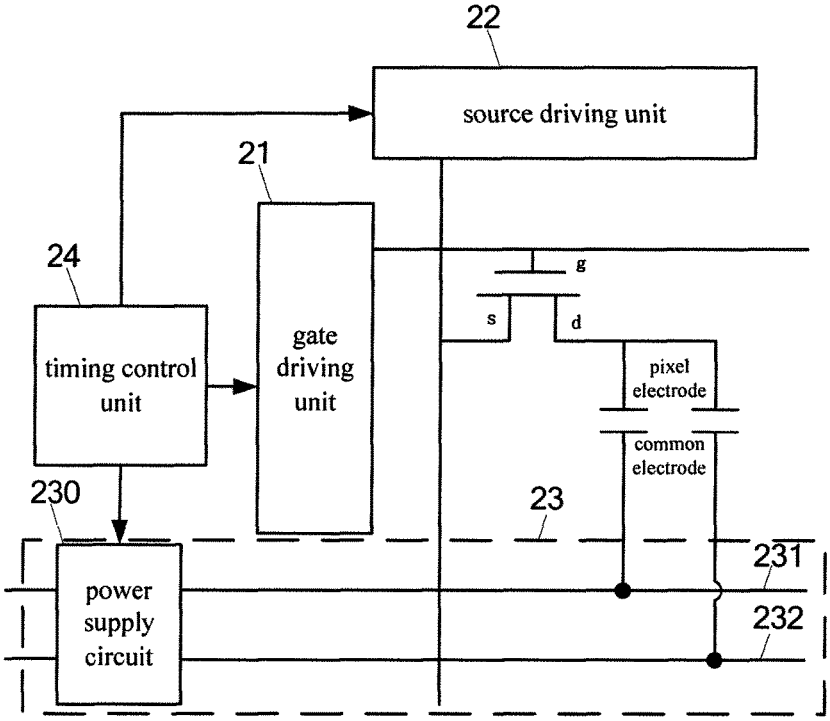
FIG. 2 is a schematic diagram of structure of a display driving circuit provided in an embodiment of the present disclosure.

As shown in FIG. 2, a display driving circuit provided in the embodiments of the present disclosure comprises a gate driving unit 21 for controlling a thin film transistor TFT to be turned on, a source driving unit 22 for outputting a signal to a source of the TFT, and a circuit unit 23 for supplying a power to a common electrode.

In an example, when the TFT is in a turn-on state, the circuit unit 23 outputs a first voltage to the common electrode; when the TFT is in a turn-off state, the circuit unit 23 outputs a second voltage to the common electrode.

In an example, the first voltage is a voltage different from the second voltage.

In the display driving circuit provided in the embodiments of the present disclosure, when the TFT is in a turn-on state, the circuit unit outputs the first voltage to the common electrode; when the TFT is in a turn-off state, the circuit unit outputs the second voltage to the common electrode, wherein the first voltage is the voltage different from the second voltage. Adopting two different voltages as reference voltages of the common electrode, the voltage of the common electrode transfers from the first voltage to the second voltage while there is a voltage transition in the voltage of the pixel electrode due to the feed through effect, such that the voltage difference between the pixel electrode and the common electrode may be maintained effectively at a required pixel voltage by controlling a relationship between values of the first voltage and the second voltage, and thus the influence of the feed through effect on the voltage difference between the pixel electrode and the common electrode may be effectively eliminated and the quality of displayed picture may be significantly improved.

Particularly, in the embodiments of the present disclosure, the voltage difference between the first voltage and the second voltage may be in a predefined range. For example, the predefined range in which the voltage difference is may be a predefined voltage interval close to a feed through voltage of the TFT, and such voltage interval is easily implemented in practice. When the voltage difference between the first voltage and the second voltage is within the interval, the voltage transition caused by the feed through effect would not have a significant influence on the light transmittance rate and the luminance of the display device. In an example, the voltage difference between the first voltage and the second voltage may be equal to the feed through voltage of the TFT. Such that the influence of the feed through effect on the voltage difference between the pixel electrode and the common electrode may be totally avoided and the quality of displayed picture may be significantly improved.

It should be noted that, in the display driving circuit as shown in FIG. 2, one TFT structure is described as an example, and it is easily known that the present disclosure is not limited thereto. In an actual implementation, the gate driving unit 21 may be connected to a plurality of gate lines, and each of the gate lines is used for controlling the turn-on or turn-off of TFTs in a corresponding row. Likewise, the source driving unit 22 may be connected to a plurality of data lines, and each of the data lines is used for outputting a signal to the sources of TFTs in a corresponding column.

Furthermore, in the display driving circuit as shown in FIG. 2, the circuit unit 23 may comprise: a power supply circuit 230, a first common electrode line 231 and a second common electrode line 232.

When the TFT is in the turn-on state, the power supply circuit 230 outputs the first voltage to the common electrode via the first common electrode line 231; when the TFT is in the turn-off state, the power supply circuit 230 outputs the second voltage to the common electrode via the second common electrode line 232.

For example, the power supply circuit 230 may have at least two voltage outputting terminals connected to the first common electrode line 231 and the second common electrode line 232, respectively, the different voltage outputting terminals may output different voltages, and the power supply circuit 230 may select any one of the voltage outputting terminals to output a corresponding voltage signal at any moment. When the TFT is in the turn-on state, the power supply circuit 230 activates the first voltage outputting terminal and deactivates the second voltage outputting terminal, and the power supply circuit 230 outputs the first voltage to the common electrode via the first common electrode line 231 at this time; when the TFT is in the turn-off state, the power supply circuit 230 activates the second voltage outputting terminal and deactivates the first voltage outputting terminal, and the power supply circuit 230 outputs the second voltage to the common electrode via the second common electrode line 232 at this time.

Figure 3:
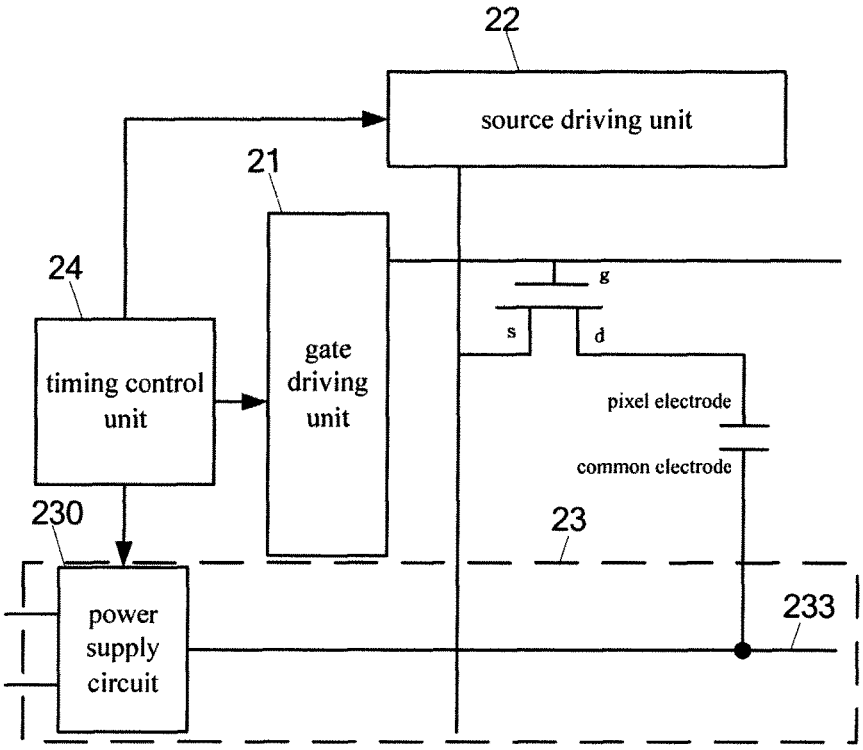
FIG. 3 is a schematic diagram of structure of another display driving circuit provided in another embodiment of the present disclosure.

Alternatively, as shown in FIG. 3, the circuit unit 23 may further comprise: a power supply circuit 230 and a common electrode line 233.

When the TFT is in the turn-on state, the power supply circuit 230 outputs the first voltage to the common electrode via the common electrode line 233; when the TFT is in the turn-off state, the power supply circuit 230 outputs the second voltage to the common electrode via the common electrode line 233.

For example, the power supply circuit 230 may comprise at least two voltage output modes and may be switched among the at least two voltage output modes, and at any moment, the power supply circuit 230 selects only one voltage output mode to output a corresponding voltage signal. When the TFT is in the turn-on state, the power supply circuit 230 operates in a first voltage output mode, and the power supply circuit 230 outputs the first voltage to the common electrode via the common electrode line 233 at this time; when the TFT is in the turn-off state, the power supply circuit 230 operates in a second voltage output mode, and the power supply circuit 230 outputs the second voltage to the common electrode via the common electrode line 233 at this time.

Furthermore, the display driving circuit as shown in FIG. 2 or FIG. 3 may further comprise: a timing control unit 24, connected to the gate driving unit 21, the source driving unit 22 and the circuit unit 23, for outputting signals according to a timing.

Particularly, during a driving period of frame, the timing control unit 24 outputs timing control signals to the gate driving unit 21, the source driving unit 22 and the circuit unit 23. When the TFT is in the turn-on state, the timing control unit 24 transmits a control signal to the circuit unit 23 so as to enable the circuit unit 23 to output the first voltage to the common electrode; when the TFT is in the turn-off state, the timing control unit 24 likewise transmits a control signal to the circuit unit 23 so as to enable the circuit unit 23 to output the second voltage to the common electrode. In this way, when the voltage at the pixel electrode transits due to the feed through effect, the voltage at the common electrode also transfers from the first voltage to the second voltage at the same time, such that the voltage difference between the pixel electrode and the common electrode may be maintained effectively as a required pixel voltage by controlling the relationship between values of the first voltage and the second voltage, and thus the influence of the feed through effect on the voltage difference between the pixel electrode and the common electrode may be effectively eliminated and the quality of displayed picture may be significantly improved.

Particularly, the display driving circuit shown in FIG. 2 as provided in the embodiments of the present disclosure will be described in detail with reference to the waveform diagram of voltages shown in FIG. 4.

During one driving period of a frame (IF), a source voltage Vs output from the source driving unit 22 is a square wave signal whose high level and low level have a same time length. When the Vs is at the high level, the timing control unit 24 controls the gate driving unit 21 to output a high level as a turn-on signal, in order to ensure the TFT to be in the turn-on state.

When the TFT is in the turn-on state, it can be seen that the voltage Vd at the pixel electrode (that is, the voltage at the drain of the TFT) rises from a low level to a high level gradually. During such process, the timing control unit 24 controls the power supply circuit 230 to output the first voltage Vcom1 via the first common electrode line 231, and the first voltage Vcom1 is the common electrode voltage at this time. The voltage difference between the pixel electrode and the common electrode is ΔV1 at this time.

The timing control unit 24 controls the gate driving unit 21 to output a low level so as to turn off the TFT. It can be seen clearly that, at the moment of TFT being turned off, the voltage Vd at the pixel electrode is decreased suddenly due to the feed through effect, the voltage difference ΔVf decreased is referred to as a feed through voltage. When the TFT is in the turn-off state, the timing control unit 24 controls the power supply circuit 230 to output the second voltage Vcom2 via the second common electrode line 232, the second voltage Vcom2 is the common electrode voltage at this time. The voltage difference between the pixel electrode and the common electrode is ΔV2 at this time. It should be noted that, in the embodiments of the present disclosure, the first voltage Vcom1 is greater than the second voltage Vcom2, and the voltage difference between the first voltage Vcom1 and the second voltage Vcom2 is the feed through voltage ΔVf. In this way, the voltage difference ΔV1 between the pixel electrode and the common electrode when the TFT is in the turn-on state is equal to the voltage difference ΔV2 between the pixel electrode and the common electrode when the TFT is in the turn-off state.

Likewise, when Vs is at the low level, the timing control unit 24 controls the gate driving unit 21 to output a high level so as to ensure the TFT to be in the turn-on state. At this time, the voltage Vdat the pixel electrode is decreased from a high level to a low level gradually. During such process, the timing control unit 24 controls the power supply circuit 230 to output the first voltage Vcom1 via the first common electrode line 231, and the first voltage Vcom1 is the common electrode voltage at this time. The voltage difference between the pixel electrode and the common electrode is ΔV3 at this time.

When the timing control unit 24 controls the gate driving unit 21 to output a low level so as to turn off the TFT, the voltage Vd of the pixel electrode is likewise decreased suddenly by the feed through voltage ΔVf due to the feed through effect at the moment of TFT being turned off. At this time, the timing control unit 24 controls the power supply circuit 230 to output the second voltage Vcom2 via the second common electrode line 232, and the second voltage Vcom2 is the common electrode voltage at this time. The voltage difference between the pixel electrode and the common electrode is ΔV4 at this time.

Figure 4:
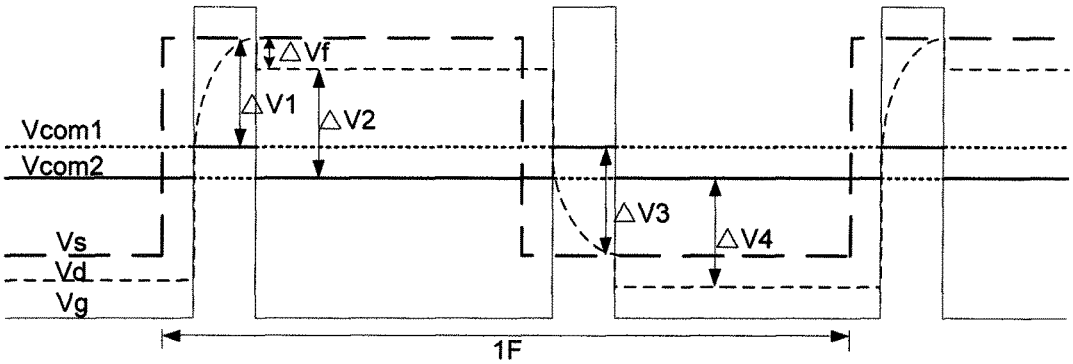
FIG. 4 is a waveform diagram of signals during a process that the display driving circuit provided in the embodiments of the present disclosure performs a display driving.

In the waveform diagram of voltages as shown in FIG. 4, the voltage differences ΔV1, ΔV2, ΔV3 and ΔV4 between the pixel electrode and the common electrode at different moments are equal to each other basically. The display driving circuit provided in the embodiments of the present disclosure may effectively maintain the voltage difference between the pixel electrode and the common electrode as a required pixel voltage, and in turn ensure that the display device has the basic same light transmittance rate and the basic same luminance before and after the TFT is turned off, so that the influence of the feed through effect on the voltage difference between the pixel electrode and the common electrode may be effectively eliminated and the quality of displayed picture may be significantly improved.

In the embodiments of the present disclosure, there is provided a display device comprising a display substrate, a display region of the display substrate comprises pixel units, each of pixel units comprises thin film transistors TFTs, and the display device further comprises the above described display driving circuit.

As shown in FIG. 2, the display driving circuit may comprise a gate driving unit 21 for controlling a thin film transistor TFT to be turned on, a source driving unit 22 for outputting a signal to a source of the TFT, and a circuit unit 23 for supplying a power to a common electrode.

In an example, when the TFT is in a turn-on state, the circuit unit 23 outputs a first voltage to the common electrode; when the TFT is in a turn-off state, the circuit unit 23 outputs a second voltage to the common electrode.

In an example, the first voltage is a voltage different from the second voltage.

The display device provided in the embodiment of the present disclosure comprises the display driving circuit, when the TFT is in a turn-on state, the circuit unit outputs the first voltage to the common electrode; when the TFT is in a turn-off state, the circuit unit outputs the second voltage to the common electrode, wherein the first voltage is the voltage different from the second voltage. Adopting two different voltages as reference voltages of the common electrode, the voltage of the common electrode transfers from the first voltage to the second voltage while there is a voltage transition in the voltage of the pixel electrode due to the feed through effect, such that the voltage difference between the pixel electrode and the common electrode may be maintained effectively at a required pixel voltage by controlling a relationship between values of the first voltage and the second voltage, and thus the influence of the feed through effect on the voltage difference between the pixel electrode and the common electrode may be effectively eliminated and the quality of displayed picture may be significantly improved.

Particularly, in the embodiments of the present disclosure, the voltage difference between the first voltage and the second voltage may be in a predefined range. For example, the predefined range in which the voltage difference is may be a predefined voltage interval close to a feed through voltage of the TFT, and such voltage interval is easily implemented in practice. When the voltage difference between the first voltage and the second voltage is within the interval, the voltage transition caused by the feed through effect would not have a significant influence on the light transmittance rate and the luminance of the display device. In an example, the voltage difference between the first voltage and the second voltage may be equal to the feed through voltage of the TFT. Such that the influence of the feed through effect on the voltage difference between the pixel electrode and the common electrode may be totally avoided and the quality of displayed picture may be significantly improved.

It should be noted that, the display device provided in the embodiments of the present disclosure may particularly be an advanced-super dimensional switching (AD-SDS) type liquid crystal display device, an in-plane-switch (IPS) type liquid crystal display device, a twist nematic (TN) type liquid crystal display device, and so on.

In the embodiments of the present disclosure, the display substrate particularly comprises an array substrate and a color filer substrate, wherein the common electrode may be formed on the surface of the array substrate, or the common electrode may be formed on the surface of the color filter substrate. For example, the common electrode of the TN type display device may be disposed on the color filter substrate and the pixel electrode is disposed on the array substrate; both of the common electrode and the pixel electrode of the ADS type display device or the IPS type display device are disposed on the array substrate. The display device provided in the embodiments of the present disclosure is not limited thereto.

In the array substrate of the ADS type display device, the common electrode and the pixel electrode may be disposed on different layers, the electrode located on an upper layer may comprise a plurality of strip electrodes, and the electrode located on a lower layer may comprise a plurality of strip electrodes or be a plate electrode. In the array substrate of the IPS type display device, the common electrode and the pixel electrode may be disposed on a same layer, the common electrode may comprise a plurality of first strip electrodes, the pixel electrode may comprise a plurality of second strip electrodes, the first strip electrodes and the second strip electrodes may be spaced.

Figure 5:
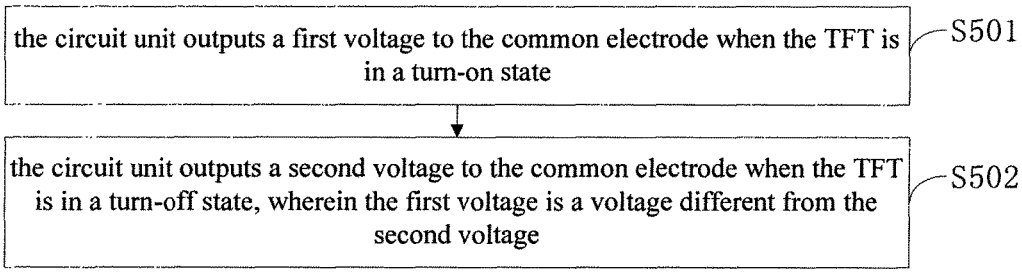
FIG. 5 is schematic flowchart of a display driving method provided in the embodiments of the present disclosure.

With the display device provided in the embodiments of the present disclosure, the voltage difference between the pixel electrode and the common electrode may be effectively controlled to maintain as a required pixel voltage, therefore it can be ensured that the display device has the basic same light transmittance rates and the basic same luminances before and after the TFT is turned off, and thus the influence of the feed through effect on the voltage difference between the pixel electrode and the common electrode may be effectively eliminated and the quality of displayed picture may be significantly improved In the embodiments of the present disclosure, there is provided a display driving method applied to a display driving circuit comprising a gate driving unit for controlling a thin film transistor TFT to be turned on, a source driving unit for outputting a signal to a source of the TFT, and a circuit unit for supplying a power to a common electrode, the display driving method is as shown in FIG. 5 and comprises:

S501, the circuit unit outputs a first voltage to the common electrode when the TFT is in a turn-on state; and

S502, the circuit unit outputs a second voltage to the common electrode when the TFT is in a turn-off state, In an example, the first voltage is a voltage different from the second voltage.

With the display driving method provided in the embodiment of the present disclosure, when the TFT is in a turn-on state, the circuit unit outputs the first voltage to the common electrode; when the TFT is in a turn-off state, the circuit unit outputs the second voltage to the common electrode, wherein the first voltage is the voltage different from the second voltage. Adopting two different voltages as reference voltages of the common electrode, the voltage of the common electrode transfers from the first voltage to the second voltage while there is a voltage transition in the voltage of the pixel electrode due to the feed through effect, such that the voltage difference between the pixel electrode and the common electrode may be maintained effectively at a required pixel voltage by controlling a relationship between values of the first voltage and the second voltage, and thus the influence of the feed through effect on the voltage difference between the pixel electrode and the common electrode may be effectively eliminated and the quality of displayed picture may be significantly improved.

Particularly, in the embodiments of the present disclosure, the voltage difference between the first voltage and the second voltage may be in a predefined range. For example, the predefined range in which the voltage difference is may be a predefined voltage interval close to a feed through voltage of the TFT, and such voltage interval is easily implemented in practice. When the voltage difference between the first voltage and the second voltage is within the interval, the voltage transition caused by the feed through effect would not have a significant influence on the light transmittance rate and the luminance of the display device. In an example, the voltage difference between the first voltage and the second voltage may be equal to the feed through voltage of the TFT. Such that the influence of the feed through effect on the voltage difference between the pixel electrode and the common electrode may be totally avoided and the quality of displayed picture may be significantly improved.

Furthermore, the circuit unit may comprise: a power supply circuit, a first common electrode line and a second common electrode line. Correspondingly, the step S501 may particularly comprise: the power supply circuit outputs the first voltage to the common electrode via the first common electrode line when the TFT is in the turn-on state.

The step S502 may particularly comprise: the power supply circuit outputs the second voltage to the common electrode via the second common electrode line when the TFT is in the turn-off state.

For example, the power supply circuit may have at least two voltage outputting terminals connected to the first common electrode line and the second common electrode line, respectively, the different voltage outputting terminals may output different voltages, and the power supply circuit may select any one of the voltage outputting terminals to output a corresponding voltage signal at any moment. When the TFT is in the turn-on state, the power supply circuit activates the first voltage outputting terminal and deactivates the second voltage outputting terminal, and the power supply circuit outputs the first voltage to the common electrode via the first common electrode line at this time; when the TFT is in the turn-off state, the power supply circuit activates the second voltage outputting terminal and deactivates the first voltage outputting terminal, and the power supply circuit outputs the second voltage to the common electrode via the second common electrode line at this time.

Alternatively, the circuit unit may further comprise: a power supply circuit and a common electrode line. Correspondingly, the step S501 may particularly comprise: the power supply circuit outputs the first voltage to the common electrode via the common electrode line when the TFT is in the turn-on state.

The step S502 may particularly comprise: the power supply circuit outputs the second voltage to the common electrode via the common electrode line when the TFT is in the turn-off state.

For example, the power supply circuit may comprise at least two voltage output modes and may be switched among the at least two voltage output modes, and at any moment, the power supply circuit selects only one voltage output mode to output a corresponding voltage signal. When the TFT is in the turn-on state, the power supply circuit operates in a first voltage output mode, and the power supply circuit outputs the first voltage to the common electrode via the common electrode line at this time; when the TFT is in the turn-off state, the power supply circuit operates in a second voltage output mode, and the power supply circuit outputs the second voltage to the common electrode via the common electrode line at this time.

With the display driving method provided in the embodiments of the present disclosure, the voltage at the common electrode would also transfer from the first voltage to the second voltage while the voltage at the pixel electrode transits due to the feed through effect, such that the voltage difference between the pixel electrode and the common electrode may be controlled effectively to maintain as a required pixel voltage according to the relationship between values of the first voltage and the second voltage, and thus the influence of the feed through effect on the voltage difference between the pixel electrode and the common electrode may be effectively eliminated and the quality of displayed picture may be significantly improved.

The above descriptions are only for illustrating the embodiments of the present disclosure. It will be obvious that those skilled in the art may make modifications, variations and equivalences to the above embodiments without departing the spirit and scope of the present disclosure as defined by the following claims. Such variations and modifications are intended to be comprised within the spirit and scope of the present disclosure.

What is claimed is:

1. A display driving circuit comprising a gate driving unit for receiving a first periodical timing control signal and controlling a thin film transistor TFT to be turned on according to the first periodical timing control signal, a source driving unit for outputting a signal to a source of the TFT, a circuit unit for receiving only one second periodical timing control signal and being driven by the only one second periodical timing control signal to supply a power to a common electrode, and a timing control unit, connected to the gate driving unit, the source driving unit and the circuit unit, for outputting the first periodical timing control signal to the gate driving unit and the second periodical timing control signal to the circuit unit, wherein the first periodical timing control signal and the second periodical timing control signal have the same timing, and during each period, when the TFT is in a turn-on state, the circuit unit only outputs a first predefined voltage to the common electrode under the control of the second periodical timing control signal; and when the TFT is in a turn-off state, the circuit unit only outputs a second predefined voltage to the common electrode under the control of the second periodical timing control signal, wherein the first predefined voltage is a voltage different from the second predefined voltage by a predefined voltage difference, and the predefined voltage difference between the first predefined voltage and the second predefined voltage is a predefined voltage interval close to a feed through voltage of the TFT.

2. The display driving circuit of claim 1, wherein the circuit unit comprises:

a power supply circuit, a first common electrode line and a second common electrode line;

when the TFT is in the turn-on state, the power supply circuit outputs the first predefined voltage to the common electrode via the first common electrode line; and when the TFT is in the turn-off state, the power supply circuit outputs the second predefined voltage to the common electrode via the second common electrode line.

3. The display driving circuit of claim 1, wherein the circuit unit comprises:

a power supply circuit and a common electrode line;

when the TFT is in the turn-on state, the power supply circuit outputs the first predefined voltage to the common electrode via the common electrode line; and when the TFT is in the turn-off state, the power supply circuit outputs the second predefined voltage to the common electrode via the common electrode line.

4. The display driving circuit of claim 1, wherein the voltage difference between the first predefined voltage and the second predefined voltage is equal to a feed through voltage of the TFT.

5. A display device comprising a display substrate, a display region of the display substrate comprises pixel units, each of pixel units comprises thin film transistors TFTs, and the display device further comprises a display driving circuit, the display driving circuit comprises a gate driving unit for receiving a first periodical timing control signal and controlling a thin film transistor TFT to be turned on according to the first periodical timing control signal, a source driving unit for receiving only one second periodical timing control signal and outputting a signal to a source of the TFT, a circuit unit for being driven by the only one second periodical timing control signal to supply a power to a common electrode, and a timing control unit, connected to the gate driving unit, the source driving unit and the circuit unit, for outputting the first periodical timing control signal to the gate driving unit and the second periodical timing control signal to the circuit unit, wherein the first periodical timing control signal and the second periodical timing control signal have the same timing, and during each period, when the TFT is in a turn-on state, the circuit unit only outputs a first predefined voltage to the common electrode under the control of the second periodical timing control signal; and when the TFT is in a turn-off state, the circuit unit only outputs a second predefined voltage to the common electrode under the control of the second periodical timing control signal, wherein the first voltage is a voltage different from the second voltage by a predefined voltage difference, and the predefined voltage difference between the first predefined voltage and the second predefined voltage is in a predefined voltage interval close to a feed through voltage of the TFT.

6. The display device of claim 5, wherein the display substrate comprises an array substrate and a color filer substrate, wherein the common electrode is formed on a surface of the array substrate.

7. The display device of claim 5, wherein the circuit unit comprises:

a power supply circuit, a first common electrode line and a second common electrode line;

when the TFT is in the turn-on state, the power supply circuit outputs the first predefined voltage to the common electrode via the first common electrode line; and when the TFT is in the turn-off state, the power supply circuit outputs the second predefined voltage to the common electrode via the second common electrode line.

8. The display device of claim 5, wherein the circuit unit comprises:

a power supply circuit and a common electrode line;

when the TFT is in the turn-on state, the power supply circuit outputs the first predefined voltage to the common electrode via the common electrode line; and when the TFT is in the turn-off state, the power supply circuit outputs the second predefined voltage to the common electrode via the common electrode line.

9. The display device of claim 5, wherein the voltage difference between the first predefined voltage and the second predefined voltage is equal to a feed through voltage of the TFT.

10. The display device of claim 5, wherein the display substrate comprises an array substrate and a color filer substrate, wherein the common electrode is formed on a surface of the color filter substrate.

11. A display driving method applied to a display driving circuit comprising a gate driving unit for receiving a first periodical timing control signal and controlling a thin film transistor TFT to be turned on according to the first periodical timing control signal, a source driving unit for outputting a signal to a source of the TFT, a circuit unit for receiving only one second periodical timing control signal and being driven by the only one second periodical timing control signal to supply a power to a common electrode according to the second periodical timing control signal, and a timing control unit, connected to the gate driving unit, the source driving unit and the circuit unit, for outputting the first periodical timing control signal to the gate driving unit and the second periodical timing control signal to the circuit unit, wherein the first periodical timing control signal and the second periodical timing control signal have the same timing, the display driving method comprises:

during each period, the circuit unit only outputs a first predefined voltage to the common electrode when the TFT is in a turn-on state under the control of the second periodical timing control signal; and the circuit unit only outputs a second predefined voltage to the common electrode when the TFT is in a turn-off state under the control of the second periodical timing control signal, wherein the first predefined voltage is a voltage different from the second predefined voltage by a predefined voltage difference, and the predefined voltage difference between the first predefined voltage and the second predefined voltage is in a predefined voltage interval close to a feed through voltage of the TFT.

12. The display driving method of claim 11, wherein the circuit unit comprises: a power supply circuit, a first common electrode line and a second common electrode line;

when the TFT is in the turn-on state, the power supply circuit outputs the first predefined voltage to the common electrode via the first common electrode line; and when the TFT is in the turn-off state, the power supply circuit outputs the second predefined voltage to the common electrode via the second common electrode line.

13. The display driving method of claim 11, wherein the circuit unit comprises: a power supply circuit and a common electrode line;

when the TFT is in the turn-on state, the power supply circuit outputs the first predefined voltage to the common electrode via the common electrode line; and when the TFT is in the turn-off state, the power supply circuit outputs the second predefined voltage to the common electrode via the common electrode line.

14. The display driving method of claim 11, wherein the voltage difference between the first predefined voltage and the second predefined voltage is equal to a feed through voltage of the TFT.

* * * * *